United States Patent [19]

Holt et al.

[11] 4,017,115

[45] Apr. 12, 1977

[54] LIFT SYSTEM FOR CONCRETE SLABS

[75] Inventors: Jack A. Holt, Belmont; Philip A. Torbet, San Mateo, both of Calif.

[73] Assignee: The Burke Company, San Mateo, Calif.

[22] Filed: Dec. 17, 1975

[21] Appl. No.: 641,529

[52] U.S. Cl. ..... 294/89; 52/707; 52/125; 294/86 R

[51] Int. Cl.[2] ..... B66C 1/66

[58] Field of Search ..... 294/89, 78 R, 82 R, 294/83 R, 93, 94, 86, 67 R, 2, 81, 92; 52/699, 700, 701, 704, 706, 707, 708, 711, 122, 125, 126

[56] References Cited

UNITED STATES PATENTS

| | | | |
|---|---|---|---|
| 2,346,482 | 4/1944 | Gold | 294/89 |
| 2,948,383 | 8/1960 | Modrey | 294/89 |
| 3,431,012 | 3/1969 | Courtois et al. | 52/125 |
| 3,583,753 | 6/1971 | McCrory | 294/86 |
| 3,590,538 | 7/1971 | Holt | 52/125 |

*Primary Examiner*—James B. Marbert
*Attorney, Agent, or Firm*—Naylor, Neal & Uilkema

[57] ABSTRACT

A lifting anchor for incorporation into a poured concrete slab. The anchor comprises a steel sleeve having an irregular exterior surface to effect a bond between the sleeve and the concrete of the slab and an interior surface defining a cylindrical opening formed with an annular abutment. During pouring, concrete is excluded from the interior of the sleeve opening by a plastic cap clipped onto the exterior of the bottom end of the sleeve and a plastic plug telescoped into the upper end of the sleeve. After formation of a slab with the anchor in place, the plug is removable to afford access to the interior of the sleeve.

A hoisting coupling is engagable with the anchor through means of a cylindrical body sized for entry into the sleeve. The inner end of the body is provided with a pair of lugs which can be extended radially outward to engage the abutment of the sleeve and contracted radially inward to afford removal of the body from the sleeve. The lugs are selectively movable between the extended and retracted positions through means of an actuating rod extending axially of the body. The outer end of the actuator rod has a device for applying tension thereto so as to permit disengagement of the lugs from the abutment from a remote location. A hoisting bail is secured to the exterior of the coupling to enable the coupling to be engaged by the lifting hook of a crane.

18 Claims, 7 Drawing Figures

LIFT SYSTEM FOR CONCRETE SLABS

BACKGROUND OF THE INVENTION

This invention relates to hoisting devices for concrete slabs and, more particularly, to a hoisting device that can be remotely disengaged and to an improved anchor structure for efficiently forming in a concrete slab a socket opening that cooperates with the hoisting device.

The known prior art relating to formation of socket openings in concrete slabs is evidenced by U.S. Pat. Nos. 3,590,538 and 3,705,469. Neither of the patents discloses a simple sleeve defining an annular abutment for engagement with a hoisting device.

Hoisting devices for concrete slabs are shown in such patents as U.S. Pat. Nos. 3,420,014; 3,431,012 and 3,652,118. The '014 and '012 patents are not adapted for remote control disengagement because they require that the entire body of the hoisting device be rotated relative to the slab. The device shown in the '118 patent is likewise incapable of affording remotely controlled disengagement because of the presence of a spreader key which is subject to extremely high frictional forces.

Removable plugs for excluding concrete from an anchor opening during placement of the concrete while in the fluid state are disclosed in such patents as U.S. Pat. Nos. 3,590,538 and 3,596,971. Those patents do not disclose a plug capable of forming a line of perforations in the concrete that covers the plug.

SUMMARY OF THE INVENTION

The present invention finds utility in the placement of concrete wall units of the type which are cast in a horizontal position and then tilted up by hoisting the same with cranes or the like into a vertical position at the building site. Engagement with the concrete slab during the hoisting and tilting up procedures is facilitated by casting an anchor within the slab during its formation. The anchor defines a socket within the slab which is closed by closure means to exclude fluid concrete from the interior of the socket. The closure means includes a plug which is locatable even if covered by a thin layer of concrete, and quickly removable after the concrete has set.

It is an object of the invention to provide a socket-forming structure and plug therefor that provides the foregoing requirements in an efficient and economical manner. The importance of providing an economical structure can be understood by appreciating that the socket-forming parts are expendable, i.e., they remain in the concrete slab after the hoisting operation is completed. The principal load-bearing element used in forming the socket is a steel sleeve in which is formed an interior cylindrical passage having an annular shoulder that defines an abutment. The exterior of the sleeve is formed with series of annular grooves.

Another object of the invention is to provide a socket-forming structure that can be easily located after the concrete has set. Concrete must be excluded from the interior of the socket-forming structure during pouring of the concrete and the invention provides an impervious plug for that purpose. The plug telescopes into part of the socket-forming structure and has, on its upper extremity, a plurality of flexible fingers arranged in a circular configuration. During casting of a slab, the plug is positioned so that the fingers extend above the level of the upper surface of the slab. Because the fingers are flexible, they yield when screeding and troweling apparatuses are moved thereover, but possess sufficient resilience to spring back into an erect condition while the concrete is fluid so as to be visible after the concrete sets. Because the fingers are spaced in a circular pattern, concrete overlaying the plug is joined to the remainder of the slab by a circular perforated line which can easily be broken to afford removal of the plug and access to the interior of the socket-forming structure.

Still another object is to provide a hoisting coupling which is engagable with the interior of the socket-forming structure and can be disengaged therefrom by a remotely controlled mechanism. Achievement of this object is important in expediting removal of the hoisting coupling after the slab is tilted up and supported. In the latter condition, the hoisting coupling is typically located at a position well above the normal reach of a workman standing on grade and, thus, the remotely controllable disengagement mechanism avoids the necessity for employing ladders, scaffolds, or the like.

Yet another object is to provide an anchor and a hoisting coupling which can be readily interengaged preparatory to hoisting or tilting up the slab. The present invention achieves this object by providing, in conjunction with the previously mentioned steel sleeve, a tubular plastic member which has a frusto-conical wall that converges from a relatively large diameter within the tubular plastic member to a relatively smaller diameter of the cylindric passage in the steel sleeve. The hoisting coupling has one or more radially movable lugs which have sloped cam surfaces that cooperate with the frusto-conical surface in the tubular plastic member so that the lugs are cammed inward to a retracted position in response to axial movement of the hoisting coupling into the socket.

The foregoing, together with other objects, features and advantages, will be more apparent after referring to the following specification and accompanying drawings.

DESCRIPTION OF THE PREFERRED EMBODIMENTS

Figure 1:
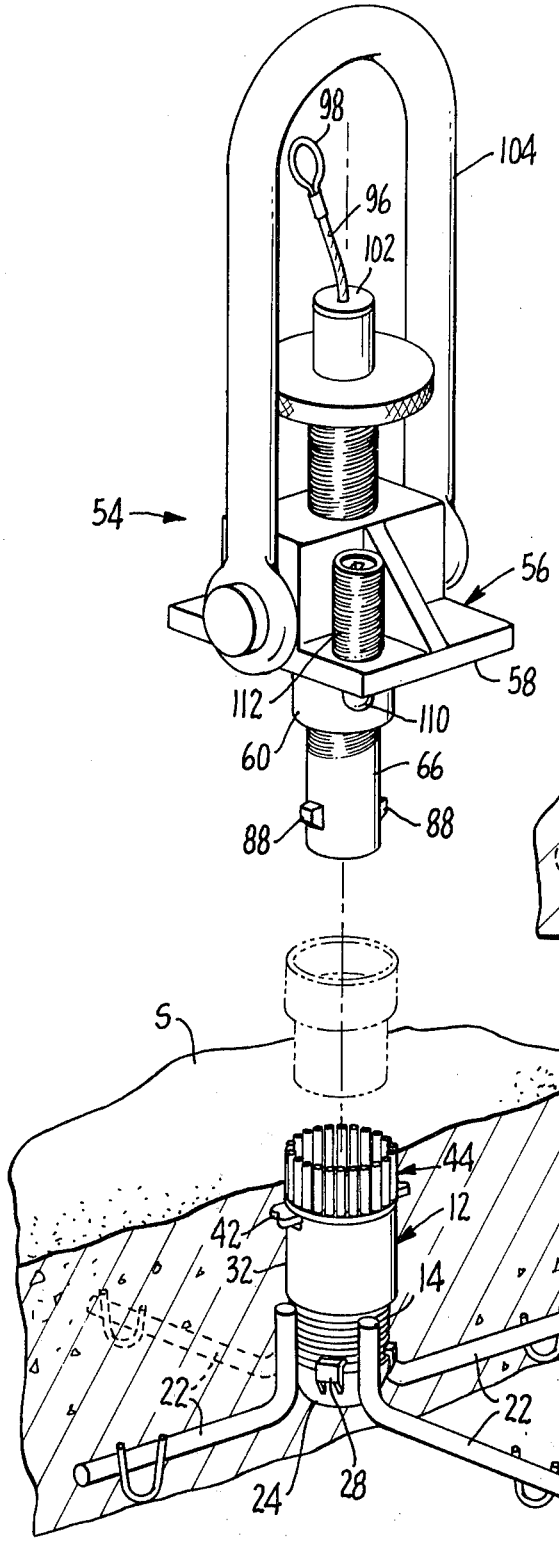
FIG. 1 is an exploded perspective view of the slab anchor and the hoisting coupling engagable therewith.

Referring more particularly to the drawings, a concrete slab C is typically formed in a horizontal position by filling a form up to a level to form a slab surface S.

A socket defining anchor 12 is placed in the form prior to introduction of fluid concrete into the form and, after the concrete has set, the anchor provides a socket to afford engagement of the slab by the hoisting coupling to be described. The anchor 12 includes a cylindrical sleeve 14 formed of high strength material such as steel. Sleeve 14 defines a cylindric passage 16, the passage being axially coextensive with the sleeve. In the lower or inner end of passage 16 is an enlarged cylindric counterbored portion 17 which defines an annular abutment shoulder 18. Because the relatively large diameter portion that defines shoulder 18 extends to the lower extremity of sleeve 14, the formation thereof can be accomplished without complicated machining procedures. The exterior surface of sleeve 14 is formed with a plurality of annular grooves 20 which form concavities into which the fluid concrete enters for affording a firm bond between sleeve 14 and the concrete slab C. For further enhancing the bond between the sleeve and the slab, legs 22 formed of reinforcing bars or the like, are welded to the exterior of the sleeve. The legs, in addition to enhancing the bond between the sleeve and the concrete slab, also support the sleeve 14 and the other parts of the anchor 12 in an upright position during introduction of fluid concrete into the form.

For excluding concrete from the lower end of passage 16, an impervious plastic cap 24 is provided. Cap 24 has a cylindric wall portion 26 which is sized for a snug, substantially fluid-tight fit within counterbore 17. On the exterior surface of cylindric portion 26, cap 24 is provided with a plurality of integrally molded fingers 28 which are provided at the distal ends thereof with inward projections 30. Inward projections 30 are so disposed with respect to the lowermost groove 20 in sleeve 14 to engage the groove and retain cap 24 in place. Because cylindric wall portion 26 engages the interior of sleeve 14, and because fingers 28 are circumferentially spaced from one another, cap 24 can be installed onto the sleeve without interference from legs 22.

For providing access to the interior of sleeve 14 after the concrete has set, there is an impervious plastic tubular member 32 which defines a cylindric passage 34 therethrough. The diameter of passage 34 exceeds the diameter of sleeve passage 16 to facilitate entry of the hoisting coupling into the passage. To afford a smooth transition between large diameter passage 34 and relatively small diameter passage 16, there is integrally molded with the tubular member 32 a frusto-conical wall 36. The diameter of the lower or smaller end of frusto-conical wall 36 is substantially equal to the diameter of passage 16 so as to afford a smooth transition between the two cylindric passages. Extending below frusto-conical wall 36 is a cylindric extension 38 which, at its lower end, defines an inwardly extending lip 40 to engage the uppermost groove 20 in sleeve 14, such engagement affording the dual functions of retaining tubular member 32 in place during placement of fluid concrete and forming a fluid-tight joint between the tubular member and the sleeve. Projecting radially outward from tubular member 32 are tabs 42 which are surrounded by the concrete so as to retain the tubular member in place when the concrete sets. As can be seen most clearly in FIG. 2, the axial extent of tubular member 32 is such that its uppermost extremity is below surface S of the concrete slab.

Figure 2:
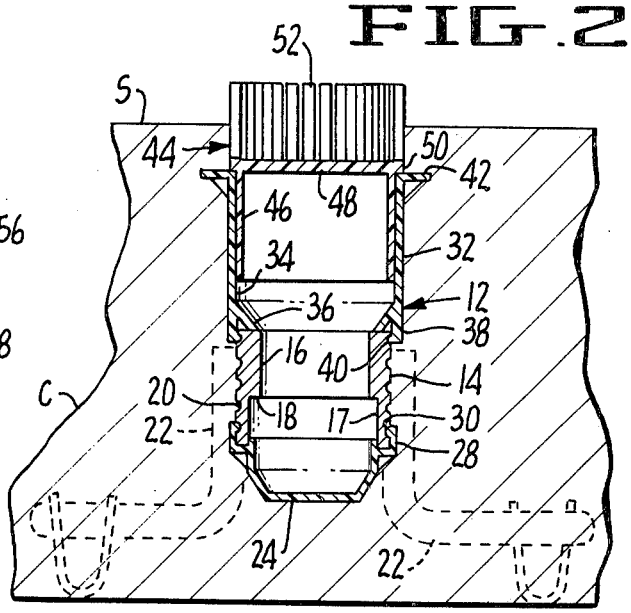
FIG. 2 is a cross-sectional elevation view of the anchor shown in place within a concrete slab.
Figure 3:
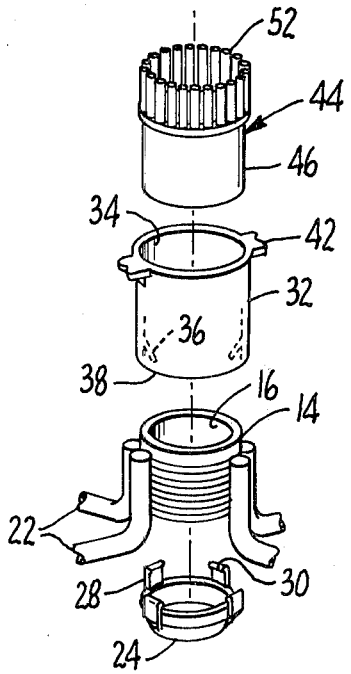
FIG. 3 is an exploded perspective view of the parts constituting the socket-forming structure of the invention, including the anchor and the plug elements therefor.

For excluding fluid concrete from the interior of tubular member 34, there is an impervious plug 44 which includes a cylindric flange 46 dimensioned for telescoping entry into passage 34 of tubular member 32. The fit between cylindric flange 46 and the surface of passage 34 is such as to form a substantially fluid-tight joint therebetween. Spanning the upper end of cylindric flange 46, and preferably integral therewith, is an impervious end plate 48. End plate 48 has an outer diameter that is slightly larger than the inner diameter of passage 34 so as to form a shoulder 50 which limits the movement of plug 44 inward of tubular member 32. A plurality of flexible fingers 52 extend upwardly from the shoulder 50 and are arranged in a circular pattern around the periphery of end plate 48. As seen in FIG. 2, the fingers have a length sufficient to extend above the surface S of concrete slab C. Because plug 44 is molded of plastic, the fingers 52 are yieldable. As a result, when screeding and/or troweling equipment is moved over surface S, the fingers deflect and do not interfere with finishing the concrete. The fingers are sufficiently resilient that they will right themselves and form a perforated line circumscribing the concrete that flows to the interior of the fingers. Consequently, when the concrete has set, the portion of the concrete confined within the circular pattern of the fingers can be quickly removed so as to afford easy removal of plug 44. Moreover, the upper ends of fingers 52 protrude above the surface S so that the location of the plug and the anchor can be determined with ease.

For engaging the anchor, the invention provides a hoisting coupling 54. Coupling 54 includes a base 56 which has a plate 58 defining a flat surface for contact with slab surface S and a depending cylindrical extension 60 having an outer diameter corresponding to the inner diameter of passage 34 in tubular member 32. Also integral with base 56 is a block 62. The block 62 and cylindric extension 60 are formed with a vertically extending threaded opening 64. Threadedly engaged in opening 64 is an elongate body 66 which defines exterior threads engagable with the threads in opening 64 to afford vertical adjustment of the body relative the base. Press fitted to the upper end of body 66 is a knurled knob 68 which affords a convenient hand grip on the body to rotate the body relative base 56 to effect such vertical adjustment.

Body 66 is axially bored at 70, and receives an actuator rod 72 sized for sliding axial movement within the bore 70. The upper extremity of bore 70 is threaded at 74 to accommodate a collar 76 which has an inner threaded portion adapted for engagement with threads 74. Collar 76 defines a cylindrical opening 78 which is coaxial with bore 70. The upper end of actuator rod 72 has a portion 80 of reduced diameter slidably received within the cylindrical opening 78 of collar 76. A shoulder 82 at the lower extremity of reduced diameter portion 80 forms an abutment for the lower end of a compression spring 84, the upper end of the spring contacting the innermost or lowermost extremity of collar 76. Spring 84 functions to bias actuator rod 72 in a downward direction, as viewed in FIG. 4.

Body 66 is provided adjacent the lower or inner end thereof with a pair of radially extending slots 86. Within the respective slots 86 are identical radially slidable lugs 88. The lower surfaces of lugs 88 have converging camming surfaces 88s to facilitate insertion of the hoist coupling into the slab socket. The lugs are movable between an extended position (See FIG. 4) in which they engage abutment 18 in sleeve 14 and a retracted position (See FIG. 5) in which they permit insertion and removal of the body 66 relative to the passage 16.

The portion of the actuator rod 72 opposite the lugs 88 is bifurcated to form spaced bifurcations 89 in which are provided inwardly converging slots 90. A pin 92 is carried by each of the lugs 88 and extends through corresponding slots 90 so that the lugs move radially to axial movement of actuator rod 72. Because of the presence of compression spring 84, actuator rod 72 is biased in a downward or inward direction (See FIG. 4) so that the lugs are biased radially outward to a protruding position. When upward force is applied to actuator rod 72, lugs 88 are moved to a retracted position (See FIG. 5) by action of the operative connection formed by slots 90 and pins 92.

Figure 4:
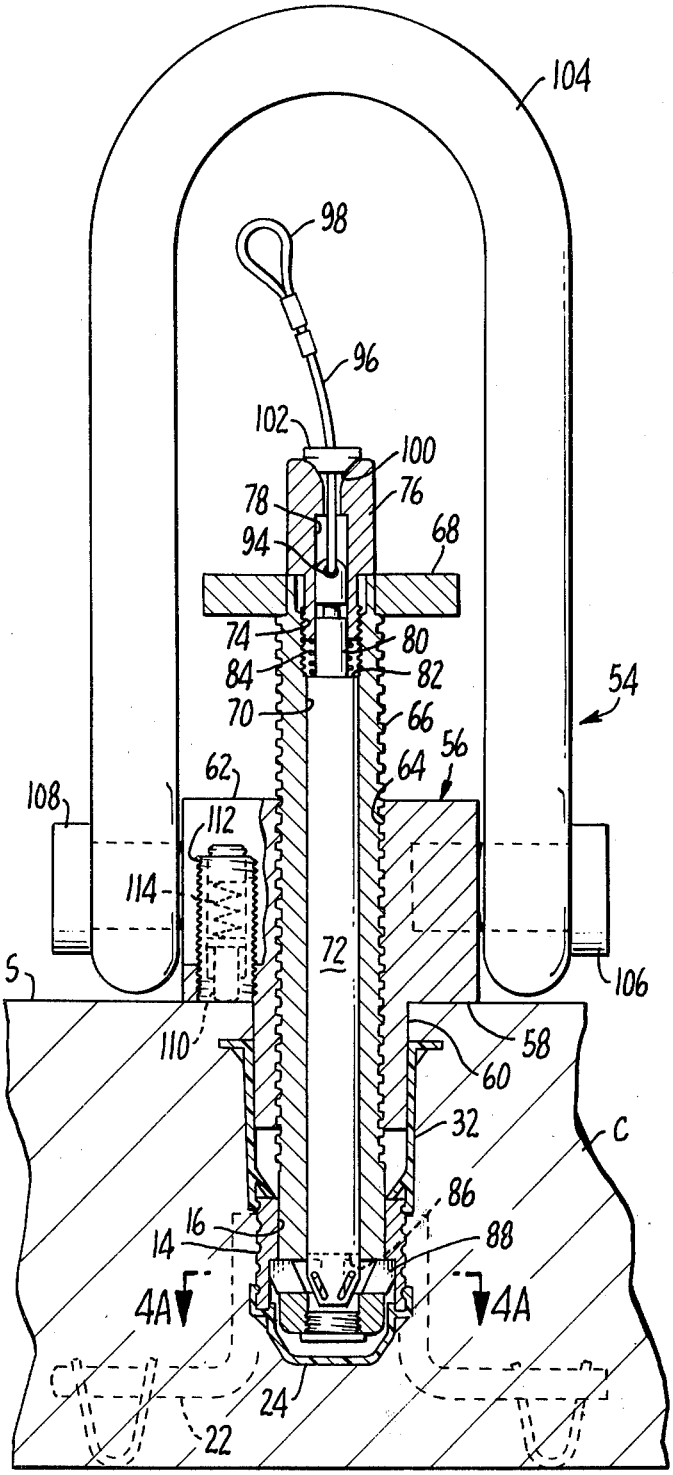
FIG. 4 is an elevation view, in cross-section, of the hoisting coupling engaged in the anchor preparatory to hoisting of the slab.
Figure 4A:
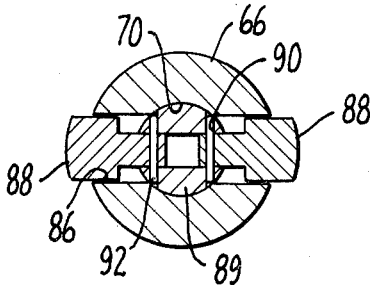
FIG. 4A is a fragmentary cross-sectional view taken on the plane designated by line 4A—4A of FIG. 4.
Figure 5:
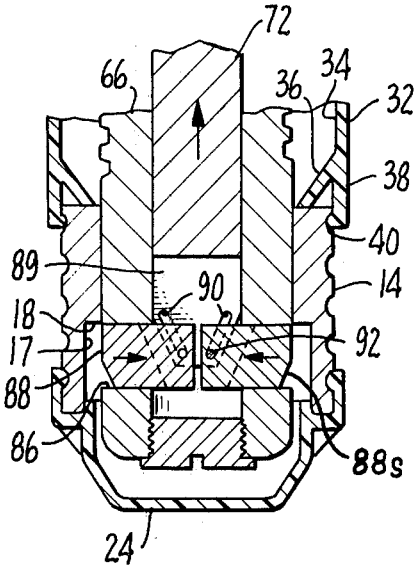
FIG. 5 is a fragmentary view of a part of FIG. 4, in enlarged scale, showing the mechanism which radially retracts the abutment engaging lugs of the hoisting coupling.

The upper end of actuator rod 72 is apertured at 94 and a flexible cable 96 is looped through the aperture so that tension on the cable will move the plunger outward against the force of the spring 84. The free end of cable 96 defines a loop 98 to which a lanyard or the like can be attached to pull the cable so as to apply outwardly directed tension to the actuator rod. Cable 96 extends through an opening in the collar 76, which opening has a flared end surface 100 to guide the cable. Fixed to cable 96 is an indicator ring 102 which has a surface complemental to flared end surface 100. Indicator ring 102 is positioned on cable 96 so that, when it is seated upon flared surface 100 as shown in FIG. 4, it affords a visual indication that lugs 88 are in the protruding position.

To afford engagement of a hoisting line with the hoisting coupling 54, there is a U-shaped bail 104 which is pivoted to base 56 by pins 106 and 108. As seen in FIG. 4, the bail 104 has a length sufficient to clear the protruding parts of the hoisting coupling and to avoid interfering with a lanyard attached to loop 98.

Protruding downward from the lower surface of the base plate 58 is a plunger 110 which is supported for axial movement within a housing 112 fixed to the plate. A compression spring 114 within the housing 12 biases the plunger 110 to the protruding position shown in FIG. 1 and permits the plunger to be moved to a retracted or flush position, as shown in FIG. 4. Compression spring 114 has sufficient force to raise hoisting coupling 54 above surface S upon disengagement of the lugs 88 from the annular abutment 18 in response to retraction of the lugs when actuator rod 72 is moved outward. Thus, as the hoisting coupling is in the process of being removed from an anchor, the plunger avoids the possibility that the lugs will be inadvertently re-engaged with the abutment.

In operation, sleeve 14, cap 24, tubular member 32 and plug 44 are assembled as shown in FIG. 1 and placed in the slab form at appropriate locations. The L-shaped legs 22 serve to support the parts of the socket-forming structure in an upright position. The form is then filled with fluid concrete up to a level above end plate 48 of plug 44 and below the upper extremities of resilient fingers 52. Thereafter, the upper surface S of the concrete is screeded and troweled so as to produce the desired surface finish and levelness. The screeding and troweling operations are not inhibited by the presence of fingers 52 because the fingers yield to movement of finishing tools thereover. When the concrete has set, a small plug of concrete within the circular pattern of fingers 52 and overlaying end plate 48 is joined to the remainder of the concrete by only a circular perforated line which is easily fractured to permit removal of the concrete plug and the plug 44, thereby exposing the interior passages 16 and 34. The cap 24 prevents fluid concrete from entering the lower end of sleeve 14.

When it is desired to lift the slab, hoisting coupling 54 is inserted into the socket opening formed as described above. In response to inward force on body 66, the lugs 88 are cammed inward by cooperation between frustoconical flange 36 in tubular member 34 and converging surfaces 88s on the lugs. Spring 84 yields to permit such camming movement. When the body 66 reaches a position within the socket such that lugs 88 are below abutment surface 18, the spring 84 forces actuator rod 72 downward, in response to which lugs 88 are forced outward to achieve engagement with the abutment shoulder 18. Such engagement occurs notwithstanding the rotative orientation of the hoisting coupling relative to slabs. Engagement between the lugs and the abutment surface can be ascertained by observing that indicator ring 102 is fully seated within the flared end surface 100 of collar 76. Thereafter, either the body 66 or the base 56 can be rotated to bring the lower surface of base plate 58 into contact with slab surface S. In bringing the base plate surface into such relationship, plunger 110 is compressed into the housing 112 and force is stored in compression spring 114.

A hoisting line is then engaged with bail 104 and the the slab can be hoisted or tilted up. When the slab is in place and is braced, the hoisting coupling 84 can be removed. Even though the hoisting coupling may be at an elevated position, it can be removed without employment of a ladder because tension on a lanyard attached to loop 98 moves actuator rod 72 outward in response to which lugs 88 are moved inward to the position in FIG. 5. When the lugs are retracted so as to disengage abutment 18, the force stored within the spring 114 is applied to the plunger 110 to raise the hoisting coupling and, thus, move at least a portion of lugs 18 into the passage 16. As a result, discontinuance of tension on cable 96 will not permit re-engagement of the lugs with the abutment 18. Thereafter, the hoisting coupling can be removed from the socket and can be employed in hoisting other similarly equipped slabs.

Figure 6:
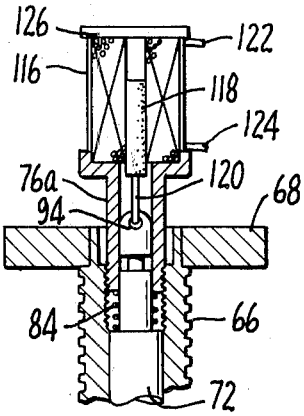
FIG. 6 is a fragmentary view of a portion of FIG. 4 showing a modified actuator for the hoisting coupling.

FIG. 6 shows a modification of the apparatus for remotely controlling retraction of actuator rod 72. The elements of the modification that are common to the embodiment shown in FIG. 4 are identified by identical reference numerals. In the modification of FIG. 6, there is a collar **76*a* which is threaded into the upper end of body 66. Collar 76*a* supports a solenoid coil 116 which has a plunger 118 attached to the aperture 94 in actuator rod 72 by a hook 120. Coil 116 has terminal conductors 122 and 124 to afford connection of power to energize the coil. When the coil is energized, plunger 120 moves upward so as to move lugs 88 to the retracted position shown in FIG. 5. Secured to the upper end of plunger 120 is a disc 126. The presence of disc 126 permits manual reciprocation of actuator rod 72 by grasping coil 116 manually and moving it upward as viewed in the figure. This affords a safety factor should some electrical defect occur in the solenoid coil. The disc 126 also serves as a visual indicator to signal the position of the rod 72.**

The operation of the modification of FIG. 6 is substantially the same as described above except that, when it is desired to release the hoisting coupling from the socket in the concrete slab, power is supplied to the coil through conductors connected to terminal conductors 122 and 124. This moves plunger 118 upward so as to move lugs 88 to the retracted position. The force of spring 114 on plunger 110 then moves the lugs up into relatively small diameter portion 16 so that discontinuance of power to coil 116 will not permit the coupling to re-engage the socket.

Thus, it will be seen that the present invention provides improved slab hoisting apparatus. The invention combines a relatively inexpensive socket-forming anchor with a remotely controllable hoisting coupling device, so that the apparatus can be employed to expedite erection of tilt-up concrete slab walls without significantly increasing the cost of the same. Moreover, time is conserved because, when the slab is braced in position and it is desired to disengage the hoisting coupling, such disengagement can be achieved from the ground and without the necessity for positioning ladders and/or scaffolds against the slab. Finally, because annular abutment 18 has a circumferential extent of 360°, the rotative position of the hoisting coupling within the slab socket is not critical. Although two embodiments of the invention have been shown and described, it will be obvious that other adaptations and modifications can be made without departing from the true spirit and scope of the invention. Accordingly, the invention is not intended to be limited to the specifics of the described embodiments, but rather is defined by the accompanying claims.

What is claimed is:

1. A remotely releasable hoisting coupling for selective engagement with a concrete slab having a surface, a cylindric passage formed in the slab in generally perpendicular relationship to the surface and opening therethrough, and an annular abutment within the passage below the surface, said coupling comprising: a cylindric body sized for entry into said passage; at least one lug engagable with said abutment and supported in said body for movement relative thereto between a position protruding laterally from said body at which the lug engages the abutment and a position retracted into said body at which the lug is disengaged from the abutment, said body defining a central bore; an actuator rod axially movable in said bore and having an inner end operatively connected to said lug and an outer end accessible from the surface of the slab; means operatively connecting said lug to said actuator rod so that in response to axial movement of the actuator rod in one direction relative said body said lug is moved to the retracted position and, in response to axial movement of the actuator rod in an opposite direction relative to said body, said lug is moved to the protruding position; means within said body for resiliently biasing said actuator rod in said opposite direction so as to correspondingly bias said lug to the protruding position; means secured to the externally accessible end of said actuator rod for selectively moving the rod axially in said one direction to move the lug to the retracted position; and, means secured to said body exterior of the slab for affording attachment of a hoisting line thereto.

2. A hoisting coupling, according to claim 1, wherein the means for moving the actuator rod comprises a cable secured to said actuator rod and extending exterior of said body.

3. A hoisting coupling, according to claim 2, including a collar fixed to said body at the outer end thereof, said collar defining an opening through which said cable is extended, said collar defining an end surface generally transverse to said opening, and a ring fixed to said cable so that said ring contacts said surface when said lugs are in the protruding position to afford a visual indication of said protruding position.

4. A hoisting coupling, according to claim 1, wherein means for moving the actuator rod comprises a solenoid having a coil and a plunger; means for supporting said coil to the exterior end of said body; and, means for attaching said plunger to said actuator rod.

5. A hoisting coupling, according to claim 4, wherein said solenoid coil supporting means is adapted to afford outward movement of said solenoid coil relative said body; and, further including means fixed to said plunger and bearing against said coil to permit outward movement of said actuator rod in response to outward movement of said coil.

6. A hoisting coupling, according to claim 1, wherein the means operatively connecting the lug to the actuator rod comprises an inner portion on the actuator rod defining a slot extending obliquely across the rod, and a pin secured to said lug interior of said bore and extending through said slot.

7. A hoisting coupling, according to claim 6, wherein said biasing means comprises: a shoulder formed on said actuator rod and facing the outer end of said actuator rod; a compression spring circumscribing said actuator rod and bearing on said shoulder; and, means rigid with said body and within said bore for bearing on the opposite end of said compression spring.

8. A hoisting coupling, according to claim 1, wherein said body has an externally threaded surface and wherein said attachment affording means includes a base defining a central opening threaded for engagement with said body, said base defining a flat surface perpendicular to said threaded opening for bearing on the surface of said slab.

9. A hoisting coupling, according to claim 8, wherein said base further comprises a plunger; means for supporting the plunger for movement in a direction perpendicular to said flat surface between a protruding position and a flush position; and means for resiliently biasing said plunger to said protruding position so that, on release of said lug from said socket, said base and said body are raised to prevent re-engagement between said lug and said abutment within said socket.

10. An anchor assembly for forming in a concrete slab a socket engagable with a hoisting coupling, said assembly comprising: a sleeve defining a cylindric passage therethrough, the passage having a first opening at one end thereof and a second opening at the opposite end thereof, said first opening being counterbored to define an annular abutment within said passage and substantially perpendicular to the axis thereof; an impervious cap secured to said sleeve and spanning said first opening to exclude concrete from said passage; an impervious tubular member secured to said sleeve in coaxial alignment with said passage at said second opening, said tubular member defining a cylindric opening having a larger diameter than said passage, said tubular member having integral therewith a frustoconical flange converging from an outer diameter equal to the cylindric opening in said tubular member to an inner diameter equal to said first opening; and an impervious plug sized to fit within said tubular member to exclude the entry of concrete into the member, said plug having an axial extent sufficient to extend to said slab surface.

11. An assembly, according to claim 10, wherein the exterior surface of said sleeve defines a plurality of annular grooves spaced therealong, said grooves having a size sufficient to afford entry of fluid concrete thereinto.

12. An assembly, according to claim 11, wherein said impervious cap includes a plurality of axially extending fingers molded integrally therewith, said fingers at the distal ends thereof having integral projections extending radially inward and sized for entry into one of said annular grooves for securing said cap to said sleeve.

13. An assembly, according to claim 12, including a plurality of generally L-shaped legs secured to the exterior of said sleeve in circumferentially spaced relation, said fingers of said cap being spaced from one another so as to engage said sleeve intermediate said legs.

14. An assembly, according to claim 11, wherein said tubular member has an inner diameter corresponding generally to the outer diameter of said sleeve, said tubular member defining at one end thereof an annular lip that extends radially inward thereof and is adapted to engage one of said annular grooves to retain said tubular member on said sleeve.

15. An assembly, according to claim 10, wherein said plug includes a shoulder larger than the diameter of said tubular member for limiting inward movement of said plug relative said tubular member, and further including a plurality of integral flexible fingers extending upward from said shoulder in a circular pattern, the outer diameter of the circular pattern being greater than the inner diameter of said tubular member, said fingers being circumferentially spaced from one another by an amount less than the diameter of said fingers so that concrete overlaying said plug can be broken away to afford removal of said plug.

16. An assembly, according to claim 10, wherein said tubular member has projecting from the exterior thereof at least one projection for engagement within the concrete of a slab to anchor the member within the slab.

17. In a plug for excluding fluid concrete from the interior of an anchor adapted to be cast within a concrete slab to provide a socket opening through the upper surface of a slab, the improvement comprising: a plurality of flexible fingers formed integrally with the plug and extending upwardly therefrom so as to extend through the upper surface of a slab cast around the anchor, said fingers being arranged in a circular pattern and circumferentially spaced from one another by an amount less than the diameter of the respective fingers whereby, when a concrete slab is cast around the anchor with the fingers extending through the upper surface of the slab, the fingers provide a perforated fracture line in the surface so that the concrete overlaying the plug can be easily broken away.

18. A hoisting coupling, according to claim 1, wherein at least two lugs are supported in said body for selective movement relative thereto by the actuator rod between the protruding and retracted positions, said respective lugs being angularly spaced relative to one another about the longitudinal axis of the cylindric body.

* * * * *